US010656553B2

(12) United States Patent
Namiki et al.

(10) Patent No.: US 10,656,553 B2
(45) Date of Patent: May 19, 2020

(54) IMAGE FORMING APPARATUS CAPABLE OF EFFICIENTLY REDUCING THE INFLUENCE OF DISCHARGE PRODUCTS ADHERING TO THE SURFACE OF AN IMAGE BEARING MEMBER

(71) Applicant: CANON KABUSHIKI KAISHA, Tokyo (JP)

(72) Inventors: Takayuki Namiki, Yokohama (JP); Yuji Kawaguchi, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/121,462

(22) Filed: Sep. 4, 2018

(65) Prior Publication Data

US 2019/0079431 A1 Mar. 14, 2019

(30) Foreign Application Priority Data

Sep. 8, 2017 (JP) ..... 2017-173444

(51) Int. Cl.
*G03G 15/06* (2006.01)
*G03G 15/00* (2006.01)
*G03G 15/02* (2006.01)

(52) U.S. Cl.
CPC ..... *G03G 15/065* (2013.01); *G03G 15/0266* (2013.01); *G03G 15/55* (2013.01)

(58) Field of Classification Search
None
See application file for complete search history.

(56) References Cited

U.S. PATENT DOCUMENTS 4,367,948 A * 1/1983 Suzuki ..... G01R 5/28 324/458
6,941,095 B2 * 9/2005 Kidaka ..... G03G 15/065 399/149
2012/0213542 A1 * 8/2012 Tsukada ..... G03G 15/11 399/71

(Continued)

FOREIGN PATENT DOCUMENTS

JP 2010113103 A 5/2010

OTHER PUBLICATIONS

JP_2010113103_A_T MachineTranslation, Japan, Kenichi ey al.*

*Primary Examiner* — Victor Verbitsky
(74) *Attorney, Agent, or Firm* — Canon U.S.A.Inc., IP Division

(57) ABSTRACT

An image forming apparatus includes an image bearing member, a charging unit that charges the image bearing member by discharge, a developing unit that rotates while being in contact with the image bearing member and supplies a developer to the image bearing member, a transfer unit that transfers a developer image from the image bearing member to a transferred member, a detecting unit that detects an electric current flowing or a voltage generated when a direct-current voltage less than a discharge starting voltage is applied to a contact member in contact with the image bearing member, and a control unit that executes detection using the detecting unit in a non-image-forming period, wherein when the detection result satisfies a first condition, the control unit starts a rotating operation for rotating the developing member, and wherein when the detection result satisfies a second condition, the control unit terminates the rotating operation.

17 Claims, 11 Drawing Sheets

(56) References Cited

U.S. PATENT DOCUMENTS

2014/0321869 A1* 10/2014 Fujihara ..... G03G 15/065
399/55
2015/0049364 A1* 2/2015 Okada ..... G06K 15/4075
358/1.15

* cited by examiner

IMAGE FORMING APPARATUS CAPABLE OF EFFICIENTLY REDUCING THE INFLUENCE OF DISCHARGE PRODUCTS ADHERING TO THE SURFACE OF AN IMAGE BEARING MEMBER

BACKGROUND OF THE INVENTION

Field of the Invention

The present disclosure relates to image forming apparatuses such as copying machines, printers, and facsimile machines using an electrophotographic system or an electrostatic recording system.

Description of the Related Art

Image forming apparatuses using an electrophotographic method or the like in the related art perform an operation of charging a photosensitive member and an image bearing member serving as an electrostatic recording dielectric by discharge. Known examples of the method for charging an image bearing member by discharge include a corona charging method and a contact charging method. In particular, the contact charging method is often employed in recent years because of the advantages of low level ozone emission and low power consumption. The contact charging method charges the surface of an image bearing member by a discharge that occurs in a minute gap between the image bearing member and a charging member in contact with the image bearing member by applying a voltage higher than a charging start voltage to the charging member. As an example of the charging member, a charging roller is widely used in the viewpoint of its excellent charging stability.

In the method of charging the image bearing member by discharging, discharge products such as ozone and nitrogen oxides (NOx) are generated, and the discharge products adhere to the surface of the image bearing member. In the contact charging method, the amount of discharge is smaller than that of the corona charging method using a corona charger, so that the amount of discharge products is small. However, in the contact charging method, discharge products are generated in a minute gap between the image bearing member and the charging member. Therefore, even if the discharge products generated is a little, the discharge products adhere to the surface of the image bearing member. When the discharge products adhere to the surface of the image bearing member, the discharge products absorb moisture to decrease the electrical resistance of the surface of the image bearing member, decreasing the charge holding capability of the image bearing member. This can cause a phenomenon called "image deletion" in which electrostatic latent images are chipped, blurred, or smeared.

Known examples of a method for reducing those influences of the discharge products include: a method of drying the surface of the image bearing member by increasing the temperature of the surface of the image bearing member with a heater disposed inside or in the vicinity of the image bearing member, a method of removing the discharge products by rotating the image bearing member while no image is being formed to increase the number of times of friction between the image bearing member and a cleaning member per unit time; a method of providing an abrasive material to the surface of the image bearing member to increase the image-bearing-member abrasive ability of the cleaning member; and a method of providing a releasing agent for enhancing the releasability to the surface of the image bearing member to make it difficult for the discharge products to adhere to the surface of the image bearing member.

The operations for reducing the influence of the discharge products described above are preferably executed when image deletion is likely to occur in order to reduce or eliminate wasteful consumption of energy and materials, wearing of the components, and a decrease in image productivity. The image deletion tends to occur in a severe use environment, for example, when the image forming apparatus is under high temperature and high humidity conditions, or when the image forming apparatus performs a printing operation for a long time. For that reason, a method of detecting a state in which image deletion is likely to occur and executing the above operations for reducing the influence of the discharge products only when needed has been proposed.

Japanese Patent Laid-Open No. 2010-113103 discloses a method of executing an image-deletion suppressing mode only when a state in which image deletion is likely to occur is detected. The method disclosed in Japanese Patent Laid-Open No. 2010-113103 detects the state in which image deletion is likely to occur using the fact that, when discharge products adhere to the surface of the image bearing member, the image bearing member is slightly charged even when a direct-current (DC) voltage less than the charge staring voltage is applied to the charging member. This method can be implemented by providing a detection circuit for detecting a current value or a voltage value when a DC voltage less than the discharge starting voltage is applied to the charging member. This eliminates the need for disposing a potential sensor for detecting the surface potential of the image bearing member around the image bearing member, which is advantageous for reducing the size and cost of the apparatus.

The above methods for reducing the influence of the discharge products, such as heating with a heater, abrasion using a cleaning member, and supplying a releasing agent, individually have a certain effect. However, according to the study of the inventors, the methods still need improvements in the viewpoint of simplification of the apparatus configuration and reduction in necessary materials. In particular, there is a cleanerless image forming apparatus that does not include a dedicated cleaning unit for removing a developer remaining on the surface of the image bearing member after a transfer process. In the cleanerless image forming apparatus, since no friction occurs between the cleaning member and the image bearing member, discharge products are likely to adhere to the surface of the image bearing member and to accumulate thereon, and the method for removing the discharge products using the friction between the cleaning member and the image bearing member cannot be used. For those reasons, a method that is advantageous for simplifying the apparatus configuration and reducing the number of necessary components and can be used in a cleanerless image forming apparatus is required.

In order to reduce or eliminate wasteful consumption of energy and materials, wearing of the components, and a decrease in image productivity, it is desirable to execute the operation for reducing the influence of discharge products when the image bearing member enters a state in which image deletion is likely to occur and to promptly complete the operation after the state is remedied. However, the method disclosed in Japanese Patent Laid-Open No. 2010-113103 executes a certain image-deletion suppressing mode when detecting the state in which image deletion is likely to occur. For that reason, the control may take more time than necessary to decrease the image productivity.

SUMMARY OF THE INVENTION

The present disclosure provides an image forming apparatus capable of efficiently reducing the influence of discharge products adhering to the surface of the image bearing member.

According to an aspect of the disclosure, an image forming apparatus includes a rotatable image bearing member, a charging member configured to charge a surface of the image bearing member, a developing member, rotating while being in contact with the image bearing member, configured to supply a developer to the surface of the image bearing member charged by the charging member, a transfer member configured to transfer an image formed of the developer on the image bearing member to a transferred member, a detecting unit configured to detect a value of an electric current flowing or a voltage generated when a direct-current voltage less than a discharge starting voltage is applied to a contact member in contact with the image bearing member, and a control unit configured to execute detection using the detecting unit in a non-image-forming period, wherein when a detection result obtained by the detecting unit satisfies a first condition, the control unit starts a rotating operation for rotating the image bearing member and the developing member in a state in which the developing member is in contact with the image bearing member, and wherein when the detection result satisfies a second condition, the control unit terminates the rotating operation.

Further features will become apparent from the following description of exemplary embodiments with reference to the attached drawings.

DESCRIPTION OF THE EMBODIMENTS

An image forming apparatus according to embodiments of the present disclosure will be described in detail below with reference to the drawings.

First Embodiment

1. Overall Configuration and Operation of Image Forming Apparatus

Figure 1:
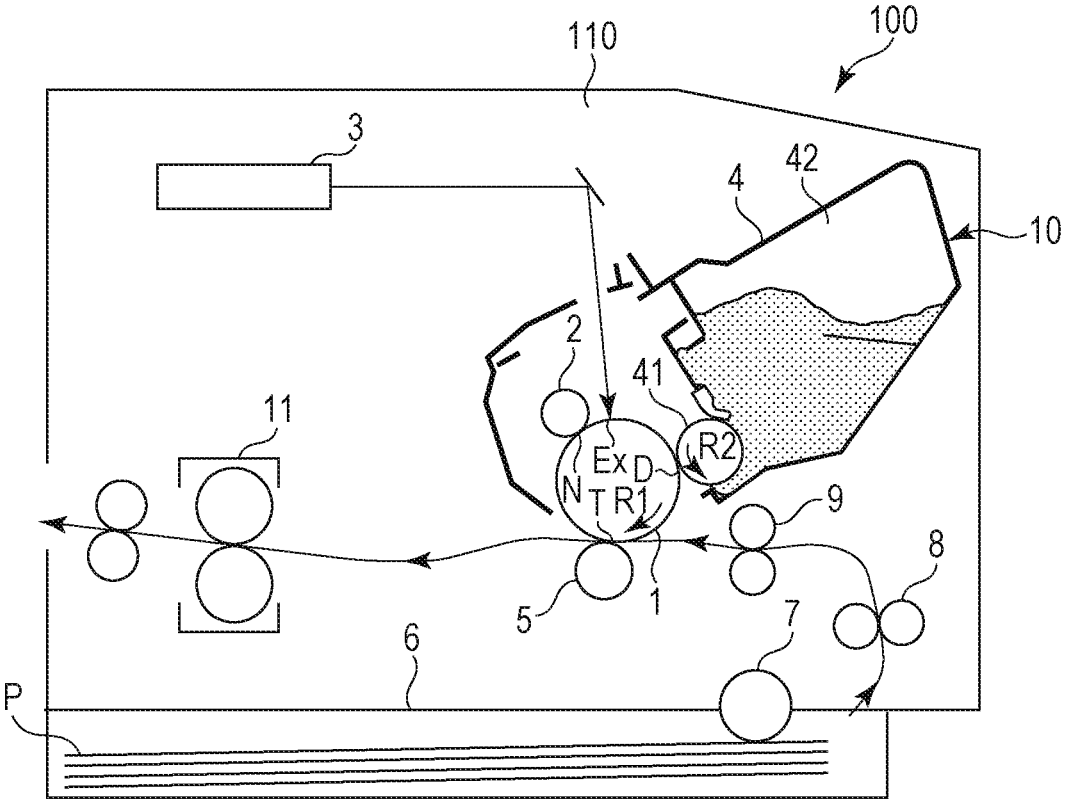
FIG. 1 is a schematic cross-sectional view of an image forming apparatus according to a first embodiment of the present disclosure.

FIG. 1 is a schematic cross-sectional view of an image forming apparatus 100 of the present embodiment. The image forming apparatus 100 of the present embodiment is a laser beam printer using electrophotography.

Figure 3:
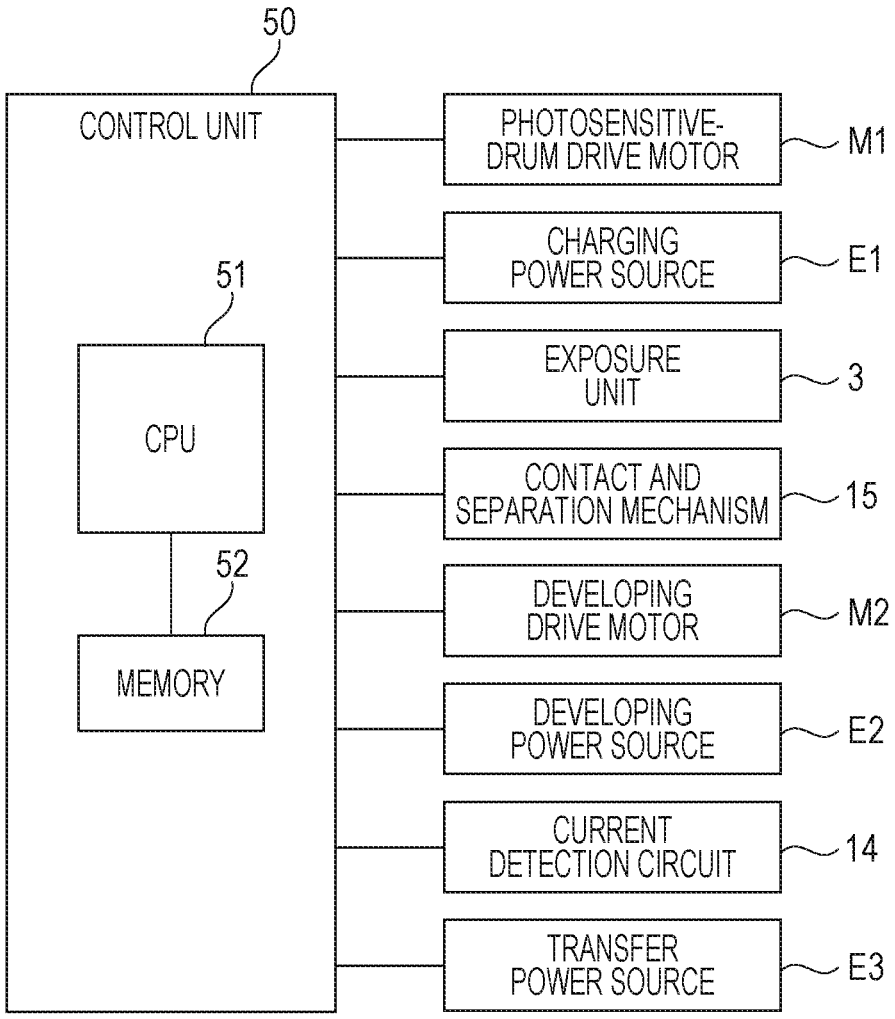
FIG. 3 is a schematic block diagram illustrating the control form of the main components of the image forming apparatus according to the first embodiment.

The image forming apparatus 100 includes a photosensitive drum 1 which is a cylindrical drum-shaped photosensitive member serving as an image bearing member. In the present embodiment, the photosensitive drum 1 has a configuration in which a foundation layer, a charge generating layer, and a charge transport layer are layered in sequence on an aluminum pipe. In the present embodiment, the foundation layer, the charge generating layer, and the charge transport layer form a photosensitive layer. The photosensitive drum 1 is rotationally driven in the direction of arrow R1 in the drawing by a photosensitive-drum drive motor M1 (a driving unit) (FIG. 3). The surface of the rotating photosensitive drum 1 is uniformly charged to a predetermined potential, which is negative in the present embodiment, by a charging roller 2, which is a roller-type charging member (a charging unit). In the present embodiment, the charging roller 2 includes a core metal and a conductive elastic layer concentrically formed around the core metal and is disposed so that the rotation axis is substantially parallel to the rotation axis of the photosensitive drum 1. The charging roller 2 is brought into contact with the photosensitive drum 1 with a predetermined pressing force. The charging roller 2 is rotated as the photosensitive drum 1 rotates. The charging roller 2 is an example of contact members that come into contact with the photosensitive drum 1. During a charging process, a charging voltage, which is a DC voltage of a negative polarity (a predetermined polarity), is applied to the charging roller 2 by a charging power source E1 (FIG. 3). In the present embodiment, the charging voltage for image formation is a DC voltage of about −1,050 V. Thus, at image formation, the surface of the photosensitive drum 1 is charged to a charge potential of −500 V. The surface of the charged photosensitive drum 1 is exposed to light by an exposure unit 3 according to the image data, so that an electrostatic latent image is formed on the photosensitive drum 1. In the present embodiment, the exposure unit 3 is a laser scanner, which emits a laser beam modulated according to the image data onto the surface of the photosensitive drum 1.

The electrostatic latent image formed on the photosensitive drum 1 is visualized by being developed with toner (a developer) supplied by a developing unit 4, so that a toner image is formed on the photosensitive drum 1. The developing unit 4 includes a developing roller 41, which is a developer bearing member (a developing member) and a developer container 42 that contains toner. The developer container 42 contains a non-magnetic toner, which is a non-magnetic one-component developer, as the developer. The developing roller 41 conveys the toner contained in the developer container 42 to a portion facing the photosensitive drum 1. In the present embodiment, the developing roller 41 has a configuration in which an aluminum pipe is coated with an elastic resin and is disposed so that the rotation axis is substantially parallel to the rotation axis of the photosensitive drum 1. The developing roller 41 is rotationally driven in the direction of arrow R2 in the drawing by a developing drive motor M2 (a driving unit) (FIG. 3). The direction of arrow R2 is the same direction as the moving direction of the photosensitive drum 1 at the portion facing the photosensitive drum 1. The developing roller 41 conveys the toner charged to a negative polarity due to friction to the portion facing the photosensitive drum 1. The developing roller 41 carrying the toner comes into contact with the photosensitive drum 1 to attach the toner to the surface of the photosensitive drum 1 according to the electrostatic latent image formed on the photosensitive drum 1. The developing roller 41 is one example of contact members that come into contact with the photosensitive drum 1. At a developing process, a developing voltage, which is a DC voltage having a negative polarity (a predetermined polarity), is applied to the developing roller 41 by a developing power source E2 (FIG. 3). The present embodiment employs a reversal development system in which toner that is charged to the same negative polarity as the charge polarity of the photosensitive drum 1 adheres to an exposed portion on the photosensitive drum 1 where the absolute value of the potential has decreased due to being uniformly charged and then exposed. In the present embodiment, the regular charge polarity of the toner, which is the charge polarity of the toner at development, is negative. The developing roller 41 and the photosensitive drum 1 can be switched between a contact state and a separated state as appropriate by a contact and separation mechanism 15 (a contact and separation unit) (FIG. 3). The developing roller 41 is generally brought into contact with the photosensitive drum 1 only when needed for a developing operation.

A transfer roller 5, which is a roller-type transfer member (a transfer unit) is opposed to the photosensitive drum 1. In the present embodiment, the transfer roller 5 includes a core metal and a conductive elastic layer concentrically formed around the core metal. The transfer roller 5 is disposes so that the rotation axis is substantially parallel to the rotation axis of the photosensitive drum 1. The transfer roller 5 is urged toward the photosensitive drum 1 to form a transfer nip at a transfer portion T where the photosensitive drum 1 and the transfer roller 5 come into contact with each other. The toner image formed on the photosensitive drum 1 is transferred onto a recording material P, such as a recording sheet, which is a transfer material conveyed between the photosensitive drum 1 and the transfer roller 5 by the operation of the transfer roller 5. In the transfer process, a transfer voltage, which is a DC voltage having a positive polarity opposite to the regular charge polarity of the toner, is applied to the transfer roller 5 by a transfer power source E3 (FIG. 3).

The recording material P is conveyed from a cassette 6 (a container) to the transfer portion T at the same timing as the timing of the toner image on the photosensitive drum 1 by a feed roller 7, a conveying roller 8, and a registration roller 9, which serve as conveying members. The recording material P to which the toner image is transferred is heated and pressed by a fixing unit 11 so that the toner image is melted and fixed and is thereafter discharged outside the apparatus main body 110 of the image forming apparatus 100.

In the present embodiment, the image forming apparatus 100 employs a cleanerless system in which a dedicated cleaning unit for removing toner remaining on the surface of photosensitive drum 1 after the transfer process is not provided. In the cleanerless system, the transfer residual toner, which is toner that is not transferred to the recording material P during the transfer process and remains on the surface of the photosensitive drum 1, is partly collected by the developing unit 4 via the developing roller 41 after being charged by the charging roller 2 and is put into the developer container 42. Another part of the transfer residual toner charged by the charging roller 2 forms a subsequent toner image. This is intended to reduce the size of the apparatus.

In the present embodiment, the photosensitive drum 1, and the charging roller 2 and the developing unit 4, which are processing unit for the photosensitive drum 1, constitute a process cartridge 10 that is detachable from the apparatus main body 110. The process cartridge 10 is replaced with new one when the toner in the developing unit 4 runs out, or when the life of the photosensitive drum 1 has expired.

Figure 2A:
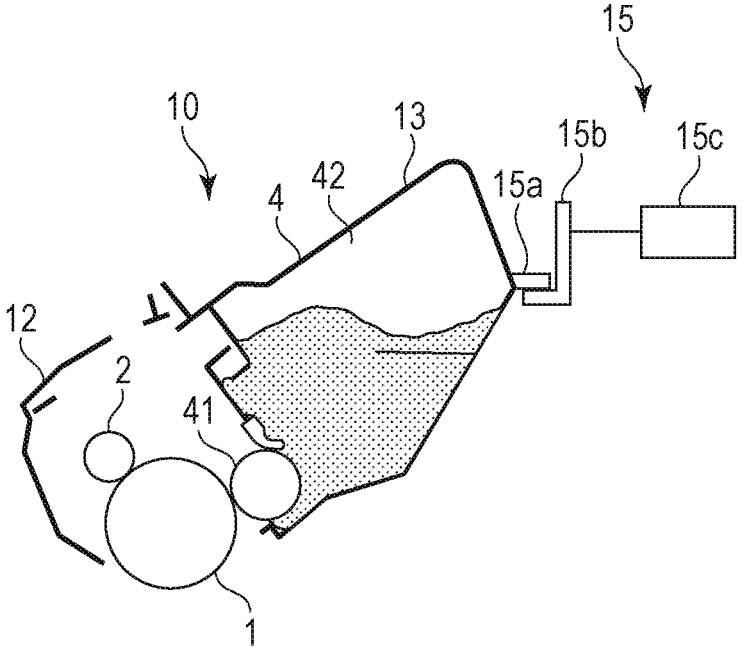
FIGS. 2A and 2B are schematic cross-sectional views of the vicinity of the developing unit illustrating the configuration and operation of a contact and separation mechanism.
Figure 2B:
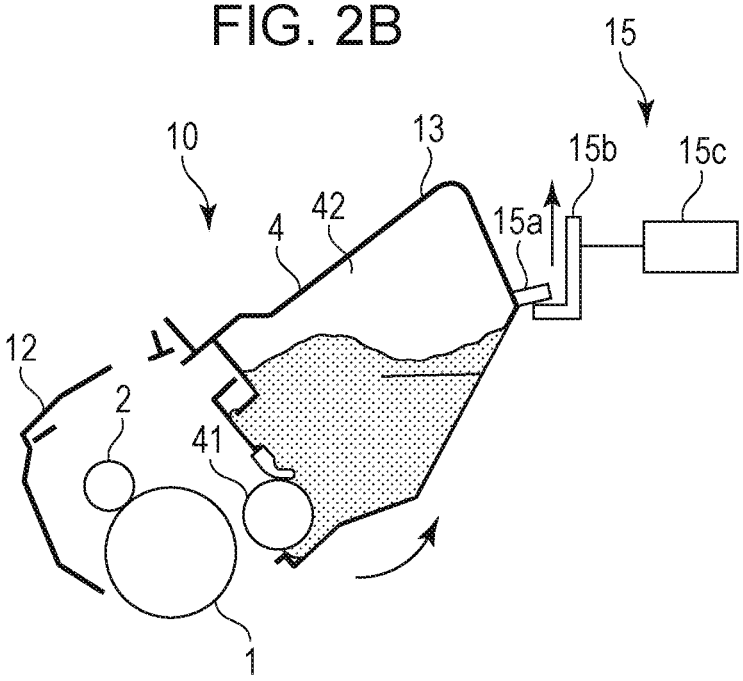

FIGS. 2A and 2B are schematic cross-sectional views of the vicinity of the developing unit 4 illustrating the configuration and operation of the contact and separation mechanism 15. FIG. 2A illustrates a state in which the developing roller 41 is in contact with the photosensitive drum 1. FIG. 2B illustrates a state in which the developing roller 41 is separated from the photosensitive drum 1. In the present embodiment, the process cartridge 10 roughly includes a drum housing 12 that supports the photosensitive drum 1 and the charging roller 2 and a development housing 13 that supports the developing roller 41 and constitutes the developer container 42. The development housing 13 is joined to the drum housing 12 so as to be able to turn about a rotation axis substantially parallel to the rotation axis of the photosensitive drum 1. The contact and separation mechanism 15 includes an engaging unit 15*a* provided on the development housing 13, a moving member 15*b* that engages with the engaging unit 15*a*, and a contact and separation unit 15*c* including a motor for driving the moving member 15*b* and a driving transmission member. The contact and separation mechanism 15 switches between the contact and the separation of the developing roller 41 and the photosensitive drum 1 by turning the development housing 13 with the moving member 15*b* via the engaging unit 15*a* to move the developing roller 41 in a direction away from or toward the photosensitive drum 1. In the present embodiment, the developing roller 41 is rotationally driven when coming into contact with the photosensitive drum 1.

Here, a position on the surface of the photosensitive drum 1, where a charging process in the rotating direction (moving direction) of the photosensitive drum 1 is performed by the charging roller 2 is a charging position. The charging roller 2 charges the photosensitive drum 1 using a discharge generated at least one of minute gaps formed between the charging roller 2 and the photosensitive drum 1 upstream and downstream of a charging nip N, which is the contact portion between the charging roller 2 and the photosensitive drum 1 in the rotational direction of the photosensitive drum 1. However, the contact portion N between the charging roller 2 and the photosensitive drum 1 may be assumed to be the charging position for simplicity. A position of the photosensitive drum in the rotational direction 1 where exposure is performed by the exposure unit 3 is an exposed position Ex. A contact portion between the developing roller 41 and the photosensitive drum 1, where toner is supplied from the developing roller 41 to the photosensitive drum 1 in the rotational direction of the photosensitive drum 1, is a developing position D. A contact portion between the photosensitive drum 1 and the transfer roller 5, where the toner image is transferred from the photosensitive drum 1 to the recording material P in the rotational direction of the photosensitive drum 1 is the transfer portion T, which is a transfer position.

2. Control Form

Figure 7A:
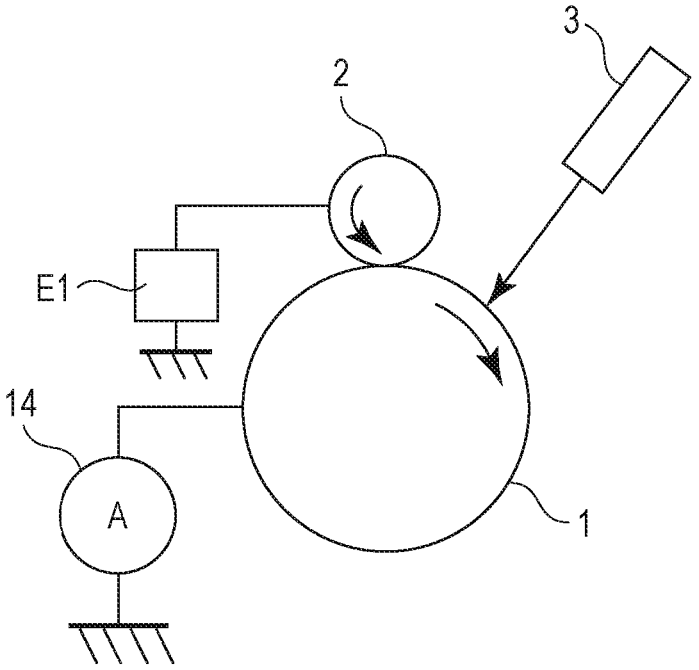
FIG. 7A is a schematic diagram of a configuration for detecting image deletion illustrating a case where a charging roller is used as a contact member that comes into contact with the photosensitive drum to apply a voltage.
Figure 7B:
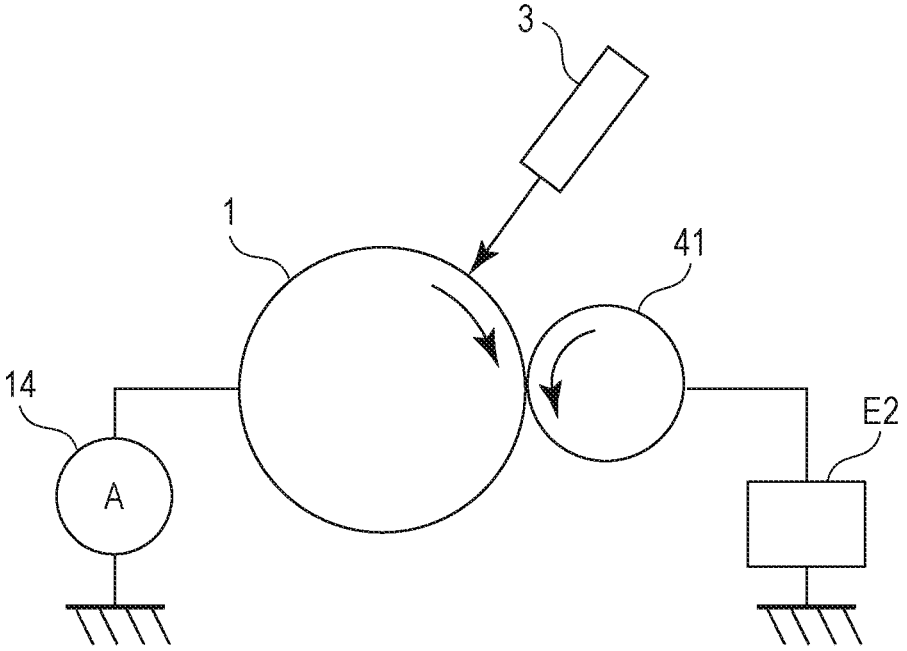
FIG. 7B is a schematic diagram of a configuration for detecting image deletion illustrating a case where a developing roller is used as a contact member that comes into contact with the photosensitive drum to apply a voltage.

FIG. 3 is a schematic block diagram illustrating the control form of the main components of the image forming apparatus 100 of the present embodiment. The apparatus main body 110 of the image forming apparatus 100 includes a control unit 50 (a control circuit). The control unit 50 includes a CPU 51 serving as a calculation control unit and a memory 52 formed of a ROM or a RAM serving as a storage unit. The CPU 51 controls the overall operation of the components of the image forming apparatus 100 according to a program stored in the memory 52. The control unit 50 connects to the photosensitive-drum drive motor M1, the developing drive motor M2, the various power sources E1 to E3, the exposure unit 3, and the contact and separation mechanism 15. The control unit 50 also connects to a current detection circuit 14 (a current detecting unit). The current detection circuit 14 detects currents flowing when voltages are applied to the photosensitive drum 1 by the charging roller 2 and the developing roller 41 which are contact members that come into contact with the photosensitive drum 1. In the present embodiment, as illustrated in FIGS. 7A and 7B, the current detection circuit 14 is connected between the photosensitive drum 1 and the ground and detects a current flowing between the photosensitive drum 1 and the ground. The control unit 50 controls the operation of the image forming apparatus 100 so as to form an image corresponding to image information input from an external unit, such as a personal computer or an image reader, on a recording material P and output the recording material P. The control unit 50 further controls an image-deletion detecting operation and an image-deletion suppressing operation, described later.

The image forming apparatus 100 executes a printing operation, which is a job that is a series of operations for forming an image on one or a plurality of recording materials P started according to a start instruction. The job generally includes an image forming process, a pre-rotation process, an inter-sheet process for forming images on a plurality of recording materials P, and a post-rotation process. The image forming process includes a process for forming an electrostatic latent image of an output image to be formed on the recording material P, a process for forming a toner image, and a process for transferring the toner image. The image forming period corresponds to these processes. More specifically, the timing of image formation differs among the positions where the electrostatic latent image is formed, the toner image is formed, and the toner image is transferred. The pre-rotation process is a preparatory operation before the image forming process is executed after a start instruction is input until image formation is actually started. The inter-sheet process is performed in the interval between a recording material P and a recording material P in a continuous image forming operation for continuously forming images on a plurality of recording materials P. The post-rotation process is a preparatory operation, which is a finishing operation after the image forming process. The non-image-forming period is a period other than the image forming period and includes the pre-rotation process, the inter-sheet process, the post-rotation process, and a pre-multiple-rotation process which is a preparatory operation for turning on the image forming apparatus 100 or returning from the sleep mode. In the present embodiment, the image-deletion detecting operation and the image-deletion suppressing operation (to be described layer) are executed during the non-image-forming period.

3. Image Deletion

Next, image deletion will be described. In the following description, the magnitude relationships of voltage values, current values, and potentials are the magnitude relationships between the absolute values thereof for convenience. For the status of the surface potential of the photosensitive drum 1, the upstream and the downstream respectively refer to upstream and downstream of the photosensitive drum 1 in the rotational direction (the moving direction of the surface).

When the photosensitive drum 1 is charged by the charging roller 2, discharge products, such as ozone and NOx, are generated due to a micro discharge phenomenon, as described above. When discharge products adhere to the surface of the photosensitive drum 1, the electrical resistance of the photosensitive drum 1 decreases, so that the electric charge for forming an electrostatic latent image escapes without being held by the photosensitive drum 1, which can cause a phenomenon called "image deletion" in which isolated dots on the image start to be chipped.

Figure 4:
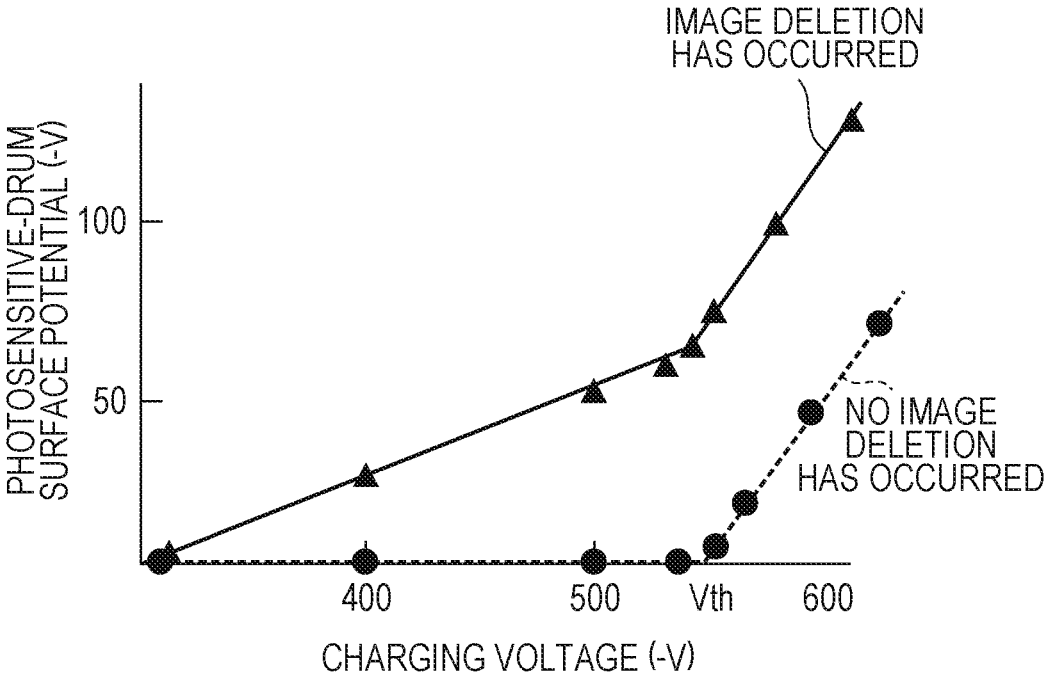
FIG. 4 is a graph showing the relationship between the charging voltage and the surface potential of a photosensitive drum that causes no image deletion and a photosensitive drum that causes image deletion according to the first embodiment.

FIG. 4 is a graph showing the results of measurement of DC voltages applied to the charging roller 2 and the surface potentials of the photosensitive drum 1 in an environment of a temperature of 23° C. and a humidity of 50% using a photosensitive drum 1 that causes no image deletion and a photosensitive drum 1 that causes image deletion.

For the photosensitive drum 1 that causes no image deletion, the surface potential does not increase while the DC voltage applied to the charging roller 2 is low, but starts to increase from a certain voltage. The value of the DC voltage at which the surface potential of the photosensitive drum 1 starts to increase is a discharge starting voltage Vth. In the present embodiment, the discharge starting voltage Vth is −550 V, for example. The discharge starting voltage Vth depends on the gap between the charging roller 2 and the photosensitive drum 1, the thickness of the photosensitive layer of the photosensitive drum 1, the relative dielectric constant of the photosensitive layer of the photosensitive drum 1, and so on. When a DC voltage higher than or equal to the discharge starting voltage Vth is applied to the charging roller 2, a discharge phenomenon occurs in the gap between the charging roller 2 and the photosensitive drum 1 based on Paschen's law to put electric charges on the surface of the photosensitive drum 1 to form a potential. In other words, the surface potential of the photosensitive drum 1 starts to increase when a DC voltage higher than or equal to the discharge starting voltage Vth is applied to the charging roller 2 and thereafter increases with a linear relationship of substantially a gradient of 1 with respect to the DC voltage applied to the charging roller 2. Therefore, in order to obtain a surface potential (charged potential) Vd of the photosensitive drum 1 necessary for electrophotography, it is necessary to apply a DC voltage of Vd+Vth to the charging roller 2. When a DC voltage of Vd+Vth is applied to the charging roller 2, electric discharge occurs between the photosensitive drum 1 and the charging roller 2 to form a potential corresponding to the DC voltage Vd on the surface of the photosensitive drum 1.

In contrast, with the photosensitive drum 1 that causes image deletion, the surface potential of the photosensitive drum 1 starts to increase even when the DC voltage applied to the charging roller 2 is lower than the discharge starting voltage Vth. When the discharge starting voltage Vth is applied to the charging roller 2, the surface potential of the photosensitive drum 1 reaches about −50 V. This is because, with the photosensitive drum 1 that causes image deletion, injection charging occurs because the electrical resistance on the surface has decreased, so that even when a DC voltage less than the discharge starting voltage Vth based on Paschen's law is applied, a minute potential is formed on the surface of the photosensitive drum 1.

Figure 5:
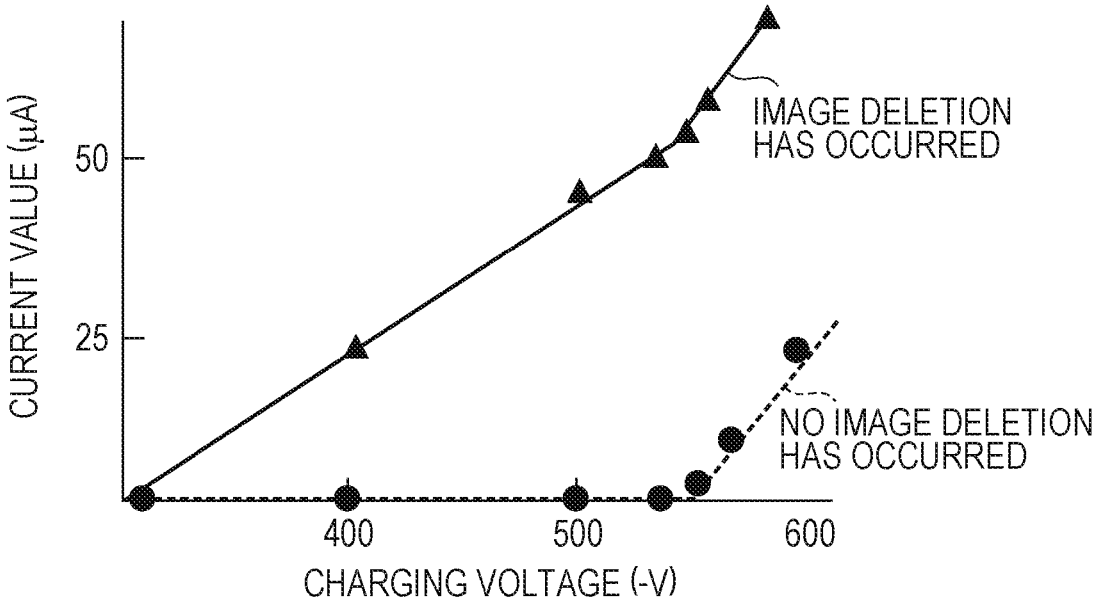
FIG. 5 is a graph showing the relationship between the charging voltage and the detected current value of a photosensitive drum that causes no image deletion and a photosensitive drum that causes image deletion according to the first embodiment.

FIG. 5 is a graph showing the results of measurement of the DC voltages applied to the charging roller 2 and the current values detected by the current detection circuit 14 using the photosensitive drum 1 that causes no image deletion and the photosensitive drum 1 that causes image deletion in the same environment as above. For the photosensitive drum 1 that causes no image deletion, when the DC voltage applied to the charging roller 2 is lower than the discharge starting voltage Vth, little electric current is detected by the current detection circuit 14. In contrast, for the photosensitive drum 1 that causes image deletion, even when the DC voltage applied to the charging roller 2 is lower than the discharge starting voltage Vth, electric currents are detected by the current detection circuit 14. This is because, with the photosensitive drum 1 that causes image deletion, when an electrical potential is produced on the surface due to injected charges, a minute electric current flows.

Figure 6A:
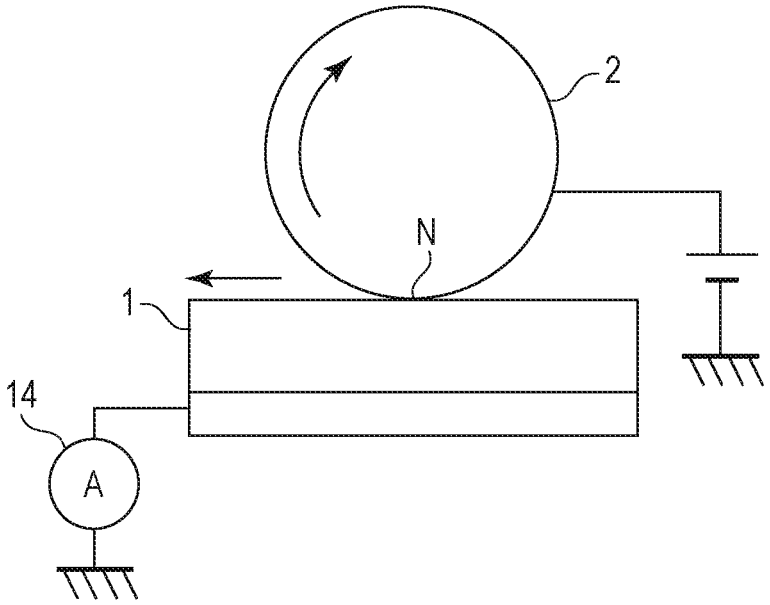
FIGS. 6A and 6B are schematic diagrams illustrating the mechanisms of causing different electric-current detection results according to the first embodiment.
Figure 6B:
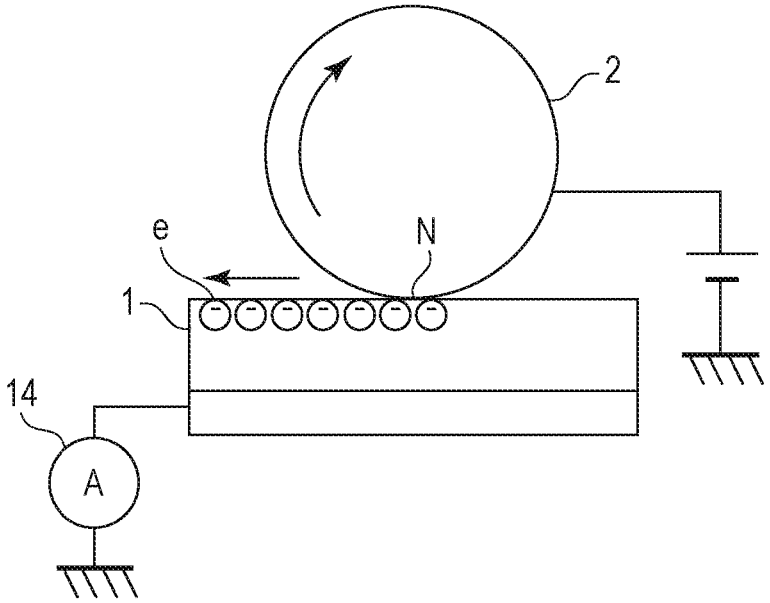

FIGS. 6A and 6B are schematic diagrams illustrating the mechanisms of causing the different electric-current detection results, as described above. FIG. 6A illustrates a case where the photosensitive drum 1 that causes no image deletion is used. FIG. 6B illustrates a case where the photosensitive drum 1 that causes image deletion is used. As illustrated in FIG. 6A, with the photosensitive drum 1 that causes no image deletion, when the DC voltage applied to the charging roller 2 is less than the discharge starting voltage Vth, a surface of the photosensitive drum 1 downstream from the charging nip N carries no electrical charge. A surface of the photosensitive drum 1 upstream from the charging nip N also carries no electrical charge. Therefore, even when a DC voltage less than the discharge starting voltage Vth is applied to the charging roller 2, no electric current flows on the photosensitive drum 1 that causes no image deletion, so that no electric current is detected by the current detection circuit 14. In contrast, as illustrated in FIG. 6B, with the photosensitive drum 1 that causes image deletion, the surface of the photosensitive drum 1 downstream from the charging nip N carries electrical charges e even when the DC voltage applied to the charging roller 2 is lower than the discharge starting voltage Vth. This is because the electrical resistance on the surface of the photosensitive drum 1 is decreased due to a moisture content reacting and adsorbed by the discharge products, so that electrical charge is injected onto the surface of the photosensitive drum 1 at the charging nip N, which is the contact portion between the charging roller 2 and the photosensitive drum 1. Therefore, with the photosensitive drum 1 that causes image deletion, even when a DC voltage less than the discharge starting voltage Vth is applied to the charging roller 2, an electric current flows, and the electric current is detected by the current detection circuit 14.

4. Principle of Method for Detecting Image Deletion

Next, the principle of a method for detecting image deletion in the present embodiment will be described. In the present embodiment, the phenomenon in which discharge products adhering to the surface of the photosensitive drum 1 causes an electric current to flow due to injected charges even when a DC voltage less than the discharge starting voltage Vth is applied, as described above, is used to determine whether the photosensitive drum 1 is in a state in which image deletion is likely to occur.

FIGS. 7A and 7B are schematic diagrams illustrating a configurations for detecting image deletion. FIG. 7A illustrates a case where the charging roller 2 is used as a contact member that comes into contact with the photosensitive drum 1 to apply a voltage to the photosensitive drum 1. FIG. 7B illustrates a case where the developing roller 41 is used as a contact member that comes into contact with the photosensitive drum 1 to apply a voltage to the photosensitive drum 1.

The configuration for detecting image deletion illustrated in FIG. 7A includes the photosensitive drum 1, the charging roller 2, the exposure unit 3, the charging power source E1, and the current detection circuit 14. Here, the developing unit 4 and the transfer roller 5 are not illustrated. In the configuration for detecting image deletion, a DC voltage less than the discharge starting voltage Vth is applied to the charging roller 2 while the whole surface of the photosensitive drum 1 is exposed to light (whole exposure) by the exposure unit 3 while being rotated, and the potential of a surface of the photosensitive drum 1 that has reached the charging nip N is kept at substantially 0 V. The term "whole exposure" refers to exposing the whole exposure range of the exposure unit 3 in the direction of the rotation axis of the photosensitive drum 1 with an exposure amount so that the surface potential of the photosensitive drum 1 is substantially 0 V. With the photosensitive drum 1 that causes no image deletion, no potential is produced on the surface of the photosensitive drum 1 downstream from the charging nip N by the above operation, so that no electric current is detected by the current detection circuit 14, as described above. In contrast, with the photosensitive drum 1 that causes image deletion, a little potential is produced on the surface of the photosensitive drum 1 downstream from the charging nip N by the above operation due to injected charges, as described above, and an electric current is detected by the current detection circuit 14. Therefore, when the value of the flowing electric current is a predetermined threshold or greater, it can be determined that image deletion is likely to occur. This threshold can be set in advance by experiment etc. according to conditions, such as the applied voltage and the environment.

The configuration for detecting image deletion illustrated in FIG. 7B includes the photosensitive drum 1, the developing roller 41, the exposure unit 3, the developing power source E2, and the current detection circuit 14. The charging roller 2 and the transfer roller 5 are not illustrated. In the configuration for detecting image deletion, the photosensitive drum 1 is rotated, and the entire surface of the photosensitive drum 1 is exposed to light by the exposure unit 3. Thereafter, a DC voltage less than the discharge starting voltage Vth is applied to the developing roller 41 in a state in which the surface potential of the photosensitive drum 1 that has reached the developing position D is at substantially 0 V. Also in this case, it can be determined that image deletion is likely to occur by detecting an electric current higher than or equal to a predetermined threshold with the current detection circuit 14, as in FIG. 7A. In other words, when an electric current higher than or equal to the predetermined threshold is not detected by the current detection circuit 14, it can be determined that image deletion is not likely to occur.

When, for example, the potential produced on the photosensitive drum 1 due to injected charges is sufficiently attenuated before reaching the charging nip N again, exposure with the exposure unit 3 may not be performed. To eliminate the potential formed of injected charges, a pre-exposure unit may be used instead of the exposure unit 3. The pre-exposure unit emits light to the photosensitive drum 1 downstream from the transfer position and upstream from the charging position in the rotational direction of the photosensitive drum 1. As another alternative, a method of applying a voltage of a polarity opposite to the charge polarity of the photosensitive drum 1 to the contact member that comes into contact with the photosensitive drum 1, such as the transfer roller 5, may be used to eliminate the potential formed of the injected charges. The elimination of the potential formed of the injected charges is not limited to bringing the surface potential of the photosensitive drum 1 to substantially 0 V. It is only required that the surface potential is less than the absolute value of a surface potential that can be produced on the photosensitive drum 1 by application of a DC voltage less than the discharge starting voltage Vth.

In the present embodiment, in determining whether to start the image-deletion suppressing operation, the image-deletion detecting operation with the detecting configuration illustrated in FIG. 7A is performed (the details will be described later). In the present embodiment, in determining whether to terminate the image-deletion suppressing operation in operation, the image-deletion detecting operation with the detecting configuration illustrated in FIG. 7B is performed (the details will be described later).

5. Image-deletion Suppressing Operation

The image forming apparatus 100 of the present embodiment employs a cleanerless system. Therefore, the surface of the photosensitive drum 1 is not scratched by the cleaning member, so that discharge products adhering to the surface of the photosensitive drum are likely to accumulate thereon without being removed. For that reason, an operation of increasing the chance of friction between the cleaning member and the photosensitive drum 1 to remove the discharge products cannot be employed when image deletion is prone to occur.

For that reason, in the present embodiment, an operation for removing discharge products adhering to the surface of the photosensitive drum 1 by rotating the developing roller 41, with the developing roller 41 in contact with the surface of the photosensitive drum 1, is executed as the image-deletion suppressing operation, which is an image deletion suppressing mode. The developing roller 41 holds toner substantially uniformly. The held toner acts as an abrasive to efficiently remove the products adhering to the surface of the photosensitive drum 1. In the present embodiment, the image-deletion suppressing operation is started when it is detected that the image deletion is prone to occur by the image-deletion detecting operation. Furthermore, in the present embodiment, the image-deletion suppressing operation is terminated when it is determined by the image-deletion detecting operation that the image deletion is not prone to occur, that is, the photosensitive drum 1 has returned to the normal state. Thus, image deletion can be efficiently suppressed by executing the image-deletion suppressing operation as necessary when needed to remove the discharge products from the surface of the photosensitive drum 1. "The image-deletion suppressing operation is terminated" refers to "the image-deletion suppressing operation that is started at one execution timing of, for example, one post-rotation process, is terminated". At the one execution timing, the image-deletion suppressing operation being executed may be interrupted halfway.

6. Control Procedure

Figure 8:
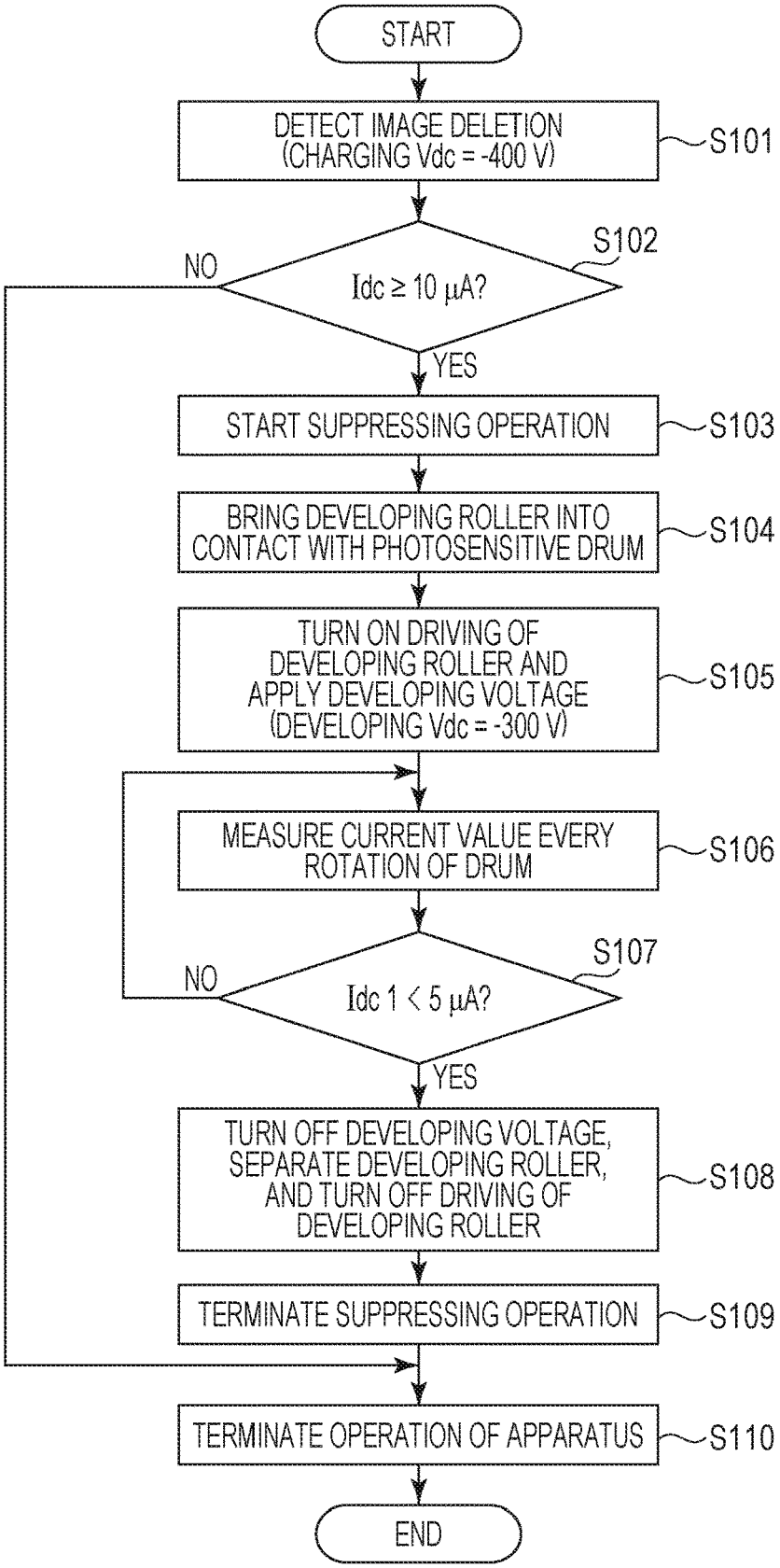
FIG. 8 is a flowchart illustrating, in outline, a control procedure according to the first embodiment.

Next, the control procedure of the image-deletion detecting operation and the image-deletion suppressing operation of the present embodiment will be described. FIG. 8 is a flowchart illustrating, in outline, the control procedure of the image-deletion detecting operation and the image-deletion suppressing operation of the present embodiment. In FIG. 8, roughly, the operation of S101 to S102 and S106 to S107 is the image-deletion detecting operation, and the operation of S103 to S105 and S108 to S109 is the image-deletion suppressing operation.

In the present embodiment, the image-deletion detecting operation and the image-deletion suppressing operation are executed by the control unit 50 in a non-image-forming period. Specifically, it is determined whether to execute the image-deletion suppressing operation in a post-rotation process after the last image formation of the job is completed. When it is determined to execute the image-deletion suppressing operation, the image-deletion suppressing operation is executed in the post-rotation process. In the present embodiment, the control for determining whether to execute the image-deletion suppressing operation is typically executed after the last image formation of the job is completed until the recording material P to which the image is transferred passes through the fixing unit 11 and is discharged to the outside of the apparatus main body 110. When it is determined to execute the image-deletion suppressing operation, the image-deletion suppressing operation is executed over a period after the recording material P is discharged to the outside of the apparatus main body 110.

The control unit 50 starts to apply a charging voltage Vdc, which is a DC voltage of −400 V less than the discharge starting voltage Vth for the charging roller 2, at a predetermined timing in the post-rotation process and obtains the result of detection of an electric current value Idc made by the current detection circuit 14 (S101). The detection of the electric current value Idc is performed over a period in which a predetermined region of the photosensitive drum 1 in the rotational direction passes through the charging nip N. At the detection, the average of the electric current value Idc may be obtained. At that time, the whole exposure with the exposure unit 3 is set to ON, the developing roller 41 is separated from the photosensitive drum 1, and the developing voltage is turned OFF, and the transfer voltage is turned OFF. Next, the control unit 50 determines whether the absolute value of the obtained electric current value Idc is greater than or equal to 10 μA (Idc≥10 μA), which is a predetermined threshold (S102). This threshold is obtained in advance by experiment for conditions for applying a DC voltage of −400 V, which is less than the discharge starting voltage Vth for the surface potential of the photosensitive drum 1 at substantially 0 V, to the charging roller 2. If in S102 the control unit 50 determines that the electric current value Idc is greater than or equal to 10 μA (Idc≥10 μA), the control unit 50 starts a discharge-product scraping operation using the developing roller 41 as the image-deletion suppressing operation (S103). The control unit 50 causes the developing roller 41 to come into contact with the photosensitive drum 1 (S104). The control unit 50 starts to rotationally drive the developing roller 41 and to apply a developing voltage Vdc, which is a DC voltage of −300 V less than the discharge starting voltage Vth for the developing roller 41 (S105). At that time, the charging voltage is turned OFF, and the transfer voltage is turned OFF. The whole exposure using the exposure unit 3 may be continuously set at ON, or the whole exposure may be set to ON only for the detection region of the electric current value Idc1 of the photosensitive drum 1 in the rotational direction.

Next, the control unit 50 regularly obtains the electric current value Idc1 detected by the current detection circuit 14 during the discharge-product scraping operation performed by the developing roller 41 (S106). In the present embodiment, the control unit 50 obtains the detection result of the current detection circuit 14 at predetermined time intervals so as to detect the electric current value Idc1 every time the photosensitive drum 1 rotates once. The detection of the electric current value Idc1 is performed over a period in which a predetermined region of the photosensitive drum 1 in the rotational direction passes through the developing position D. At the detection, the average of the electric current value Idc1 may be obtained. The control unit 50 determines whether the absolute value of the obtained electric current value Idc1 is less than 5 μA (Idc1<5 μA), which is a predetermined threshold, every time the electric current value Idc1 is obtained (S107). This threshold is obtained in advance by experiment for conditions for applying a DC voltage of −300 V, which is less than the discharge starting voltage Vth for the surface potential of the photosensitive drum 1 at substantially 0 V, to the developing roller 41.

If in S107 the control unit 50 determines that the electric current value Idc1*l* is less than 5 μA (Idc1<5 μA), the control unit 50 turns OFF the developing voltage and turns OFF the rotation driving of the developing roller 41 to separate the developing roller 41 from the photosensitive drum 1 (S108). The control unit 50 terminates the image-deletion suppressing operation (S109). Thereafter, upon completion of the operation of a predetermined post-rotation process other than the image-deletion suppressing operation, the control unit 50 stops the operation of the image forming apparatus 100 (S110). If in S107 the control unit 50 determines that the electric current value Idc1 is not less than 5 μA (Idc1≥5 μA), the control unit 50 returns the process to S106 to continue the discharge-product scraping operation using the developing roller 41.

If in S102 the control unit 50 determines that the electric current value Idc is not greater than or equal to 10 μA (Idc<10 μA), the control unit 50 stops the operation of the image forming apparatus 100 upon completion of the operation of the predetermined post-rotation process other than the image-deletion suppressing operation (S110).

7. Advantageous Effects

Next, the result of an endurance test performed to verify the advantageous effects of the present embodiment will be described. In the endurance test, printing was performed up to 10,000 sheets, during which images for evaluation were output to determine whether image deletion has occurred. Whether image deletion has occurred is determined by measuring the reduction rate of the densities of halftone image patches in the images for evaluation. Here, the reflection density of a halftone image patch in a state in which no image deletion has occurred was set at 0.5 as a reference. It was determined that image deletion has occurred when the reflection density was 0.4 or less, that is, the reflection density was 80% or less of the reference patch. The reflection density was measured using a spectral densitometer X-Rite 504/508 (manufactured by X-Rite Inc.). Specific conditions for the endurance test are shown below.

[Conditions for Endurance Test]

Environment: Temperature at 30° C., humidity at 85%

Print mode: One sheet intermittent

Interval between evaluation images: Every 2,000 sheets

[Conditions for Configuration of Mage Forming Apparatus]

Process speed: 200 mm/sec

Photosensitive-drum rotation speed: 2.66 sec/lap

Developing-roller rotation speed (relative to photosensitive drum): 140%

[Conditions for Image-deletion Detecting Operation and Image-deletion Suppressing Operation]

<Conditions in S101 to S102 of FIG. 8>

Charging voltage Vdc: −400 V

Threshold of image deletion detection: 10 μA

<Conditions in S105 to S107 of FIG. 8>

Developing voltage Vdc: −300 V

Threshold of image deletion detection: 5 μA

[Conditions for Image Formation]

Charging voltage: DC −1,050 V

Developing voltage: DC −350 V

Similar endurance tests were performed for Comparative Examples 1 to 3. The configurations and operations of the image forming apparatuses of Comparative Example 1 to 3 are substantially the same as those of the image forming apparatus of the present embodiment except the following points.

Comparative Example 1: The image-deletion suppressing operation is not executed.

Comparative Example 2: After a predetermined number of sheets are printed, the image-deletion suppressing operation is executed for a predetermined time.

Comparative Example 3: After a state in which image deletion is prone to occur is detected, the image-deletion suppressing operation (a discharge-product scraping operation with the developing roller 41) is executed for a predetermined time, as in the present embodiment.

The results of the present embodiment and Comparative Examples 1 to 3 are shown in Table 1.

TABLE 1

| | Beginning | 2,000 sheets | 4,000 sheets | 6,000 sheets | 8,000 sheets | 10,000 sheets |
|---|---|---|---|---|---|---|
| First embodiment | Good | Good | Good | Good | Good | Good |
| Comparative Example 1 | Good | Poor | Poor | Poor | Poor | Poor |
| Comparative Example 2 | Good | Good | Good | Okay | Okay | Okay |
| Comparative Example 3 | Good | Good | Good | Good | Okay | Okay |

Good: No problem in output image

Poor: image with image deletion

Okay: no image deletion but streaks in output image

In Comparative Example 1, image deletion occurred after 2,000 sheets were printed. This is because, since this example does not have a unit for removing discharge products adhering to the surface of the photosensitive drum 1, the discharge products gradually accumulated on the surface of the photosensitive drum 1, so that the electrical resistance of the surface of the photosensitive drum 1 decreased.

In Comparative Example 2 and Comparative Example 3, no image deletion occurred, but vertical streak images (streak image defects extending in the conveying direction of the recording material P) occurred at the latter half of the endurance test. This seems to be due to streaky scratches formed on the surface of the photosensitive drum 1 because of excessive friction between the developing roller 41 and the photosensitive drum 1.

In contrast, in the present embodiment, good images could be output from the beginning to the latter half of the endurance test for 10,000 prints. This is probably because, only when it is detected that image deletion is likely occur, the developing roller 41 and the photosensitive drum 1 are rubbed with each other for a necessary time until image deletion may no longer occur, so that discharge products can be efficiently removed. According to the present embodiment, the image forming apparatus 100 that employs a cleanerless system can efficiently suppress image deletion due to discharge products adhering to the surface of the photosensitive drum 1, allowing good images to be output for a long time.

Thus, the image forming apparatus 100 of the present embodiment includes the detecting unit 14 for detecting an electric current flowing or a voltage generated when a DC voltage less than a discharge starting voltage on a contact member in contact with the photosensitive drum 1. Furthermore, the image forming apparatus 100 includes the control unit 50 that performs the following control in a non-image-forming period. In other words, the control unit 50 controls the detecting unit 14 to perform detection, and when the result of detection made by the detecting unit 14 satisfies a first condition, the control unit 50 starts the image-deletion suppressing operation, which is a rotating operation for rotating the developing roller 41, with the developing roller 41 in contact with the photosensitive drum 1. When the result of detection made by the detecting unit 14 satisfies a second condition, the control unit 50 terminates the rotating operation. In the present embodiment, the control unit 50 starts the rotating operation when the absolute value of the electric current value or the voltage value detected by the detecting unit 14 is greater than or equal to a first threshold (the first condition). The control unit 50 terminates the rotating operation when the absolute value of the electric current value or the voltage value detected by the detecting unit 14 becomes less than a second threshold (the second condition). In the present embodiment, the control unit 50 determines whether the result of detection made by the detecting unit 14 in the case where the charging roller 2 is used as a contact member satisfies the first condition. The control unit 50 determines whether the result of detection made by the detecting unit 14 in the case where the developing roller 41 is used as a contact member satisfies the second condition. In the present embodiment, the control unit 50 determines whether the result of detection made by the detecting unit 14 satisfies the second condition every time the rotating photosensitive drum 1 rotates once.

As described above, according to the present embodiment, even the image forming apparatus 100 that employs a cleanerless system can efficiently reduce the influence of discharge products adhering to the surface of the photosensitive drum 1.

Second Embodiment

Next, another embodiment of the present disclosure will be described. The basic configuration and operation of an image forming apparatus according to the second embodiment are the same as those of the image forming apparatus according to the first embodiment. For that reason, components having the same or corresponding functions or configurations of the image forming apparatus of the present embodiment as those of the image forming apparatus of the first embodiment are given the same reference signs as those of the first embodiment, and detailed descriptions will be omitted.

1. Outline of the Present Embodiment

The image-deletion suppressing operation described in the first embodiment allows the discharge products adhering to the surface of the photosensitive drum 1 to be efficiently removed. However, the application of a voltage to the developing roller 41 in the image-deletion suppressing operation forms an electric field in which toner spatters from the developing roller 41 to the photosensitive drum 1, so that the toner on the developing roller 41 is transferred to the photosensitive drum 1.

Thus, the present embodiment applies a voltage to the charging roller 2 in the image-deletion suppressing operation to suppress spattering of toner from the developing roller 41 to the photosensitive drum 1, thereby reducing toner consumption.

Figure 9:
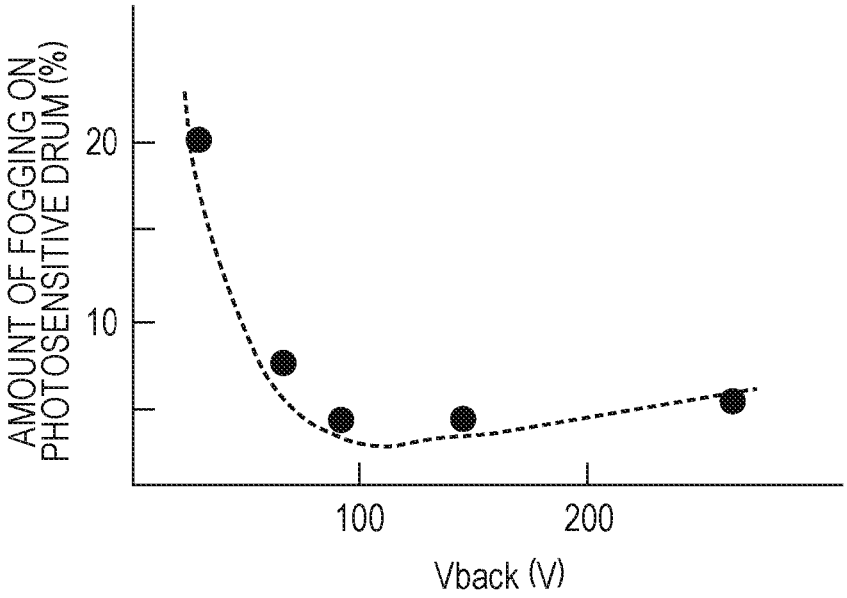
FIG. 9 is a graph showing the relationship between a potential difference Vback and the amount of fogging according to a second embodiment of the present disclosure.

FIG. 9 is a graph illustrating the relationship between the potential difference Vback between the developing roller 41 and the photosensitive drum 1 and the amount of fogging, which is the toner spattering to the photosensitive drum 1. Typically, by setting the potential of the developing roller 41 and the potential of the photosensitive drum 1 during the image-deletion suppressing operation so as to achieve a potential difference Vback at which the amount of fogging reaches the lower limit, the toner consumption during the image-deletion suppressing operation can be reduced. In the present embodiment, the developing voltage Vdc, which is a DC voltage to be applied to the developing roller 41, is set to −450 V, and the charging voltage Vprdc, which is a DC voltage to be applied to the charging roller 2, during the image-deletion suppressing operation, is set to −1,050 V to set Vback to 150 V, based on the relationship in FIG. 9. The charging voltage Vprdc is a DC voltage higher than or equal to the discharge starting voltage Vth for the surface potential of the photosensitive drum 1 at approximately 0 V and is the same as the charging voltage for image formation. The developing voltage Vdc is a DC voltage less than the discharge starting voltage Vth for the charge potential (−600 V) of the photosensitive drum 1 charged by application of the charging voltage Vprdc.

2. Control Procedure

Figure 10:
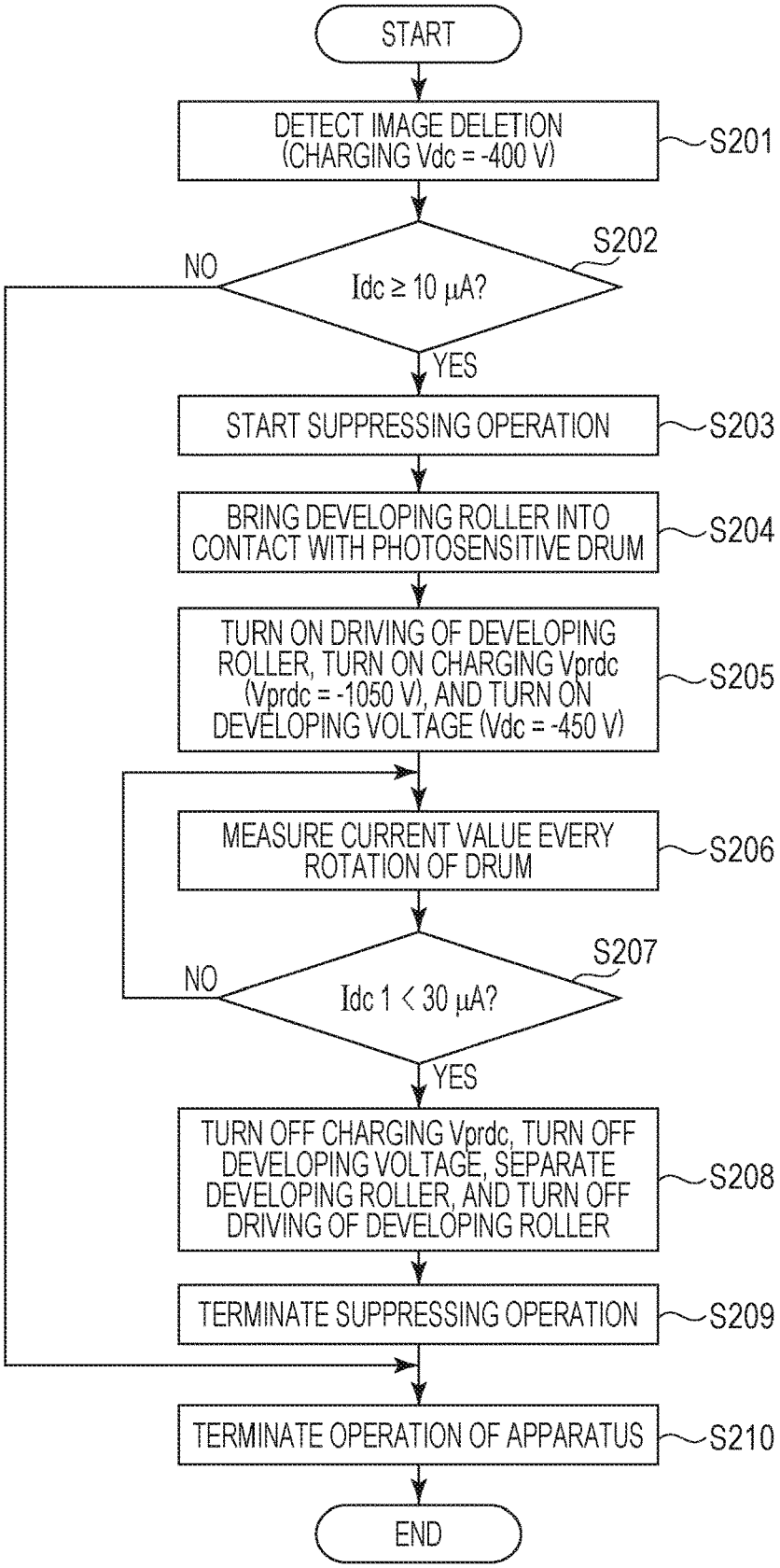
FIG. 10 is a flowchart illustrating, in outline, a control procedure according to the second embodiment.

Next, the control procedure of the image-deletion detecting operation and the image-deletion suppressing operation of the present embodiment will be described. FIG. 10 is a flowchart illustrating, in outline, the control procedure of the image-deletion detecting operation and the image-deletion suppressing operation of the present embodiment. In FIG. 10, roughly, the operation of S201 to S202 and S206 to S207 is the image-deletion detecting operation, and the operation of S203 to S205 and S208 to S209 is the image-deletion suppressing operation.

The control unit 50 starts to apply a charging voltage Vdc, which is a DC voltage of −400 V less than the discharge starting voltage Vth for the charging roller 2, at a predetermined timing in the post-rotation process and obtains the result of detection of the electric current value Idc made by the current detection circuit 14 (S201). At that time, the whole exposure with the exposure unit 3 is set to ON, the developing roller 41 is separated from the photosensitive drum 1, and the developing voltage is turned OFF, and the transfer voltage is turned OFF. Next, the control unit 50 determines whether the absolute value of the obtained electric current value Idc is greater than or equal to 10 μA (Idc≥10 μA), which is a predetermined threshold (S202). If in S202 the control unit 50 determines that the electric current value Idc is greater than or equal to 10 μA (Idc≥10 μA), the control unit 50 starts a discharge-product scraping operation, which is the image-deletion suppressing operation, using the developing roller 41 (S203). The control unit 50 causes the developing roller 41 to come into contact with the photosensitive drum 1 (S204). The control unit 50 starts to rotationally drive the developing roller 41 and to apply a developing voltage Vdc, which is a DC voltage of −450 V for the developing roller 41, and a charging voltage Vprdc, which is a DC voltage of −1,050V for the charging roller 2

(S205). At that time, the exposure with the exposure unit 3 is turned OFF, and the transfer voltage is turned OFF.

Next, the control unit 50 regularly obtains the electric current value Idc1 detected by the current detection circuit 14 while continuing the discharge-product scraping operation using the developing roller 41 (S206). In the present embodiment, the control unit 50 obtains the result of detection performed by the current detection circuit 14 at predetermined time intervals so as to detect the electric current value Idc1 every time the photosensitive drum 1 rotates once. The control unit 50 determines whether the absolute value of the obtained electric current value Idc1 is less than 30 μA (Idc1<30 μA), which is a predetermined threshold, every time the electric current value Idc1 is obtained (S207). This threshold is obtained in advance by experiment for conditions for applying a DC voltage of −450 V, which is less than the discharge starting voltage Vth for the charge potential (−600 V) of the photosensitive drum 1 charged by application of the charging voltage Vprdc, to the developing roller 41.

If in S207 the control unit 50 determines that the electric current value Idc1 is less than 30 μA (Idc1<30 μA), the control unit 50 turns off the charging voltage, turns OFF the developing voltage, and turns OFF the rotation driving of the developing roller 41 to separate the developing roller 41 from the photosensitive drum 1 (S208). The control unit 50 terminates the image-deletion suppressing operation (S209). Thereafter, upon completion of the operation of a predetermined post-rotation process other than the image-deletion suppressing operation, the control unit 50 stops the operation of the image forming apparatus 100 (S210). If in S207 the control unit 50 determines that the electric current value Idc1 is not less than 30 μA (Idc1≥30 μA), the control unit 50 returns the process to S206 to continue the discharge-product scraping operation using the developing roller 41.

If in S202 the control unit 50 determines that the electric current value Idc is not greater than or equal to 10 μA (Idc<10 μA), the control unit 50 stops the operation of the image forming apparatus 100 upon completion of the operation of the predetermined post-rotation process other than the image-deletion suppressing operation (S210).

3. Advantageous Effects

Next, the results of an endurance test conducted to verify the advantageous effects of the second embodiment will be described. The endurance test was conducted in the same manner as described in the first embodiment, in which it was determined whether image deletion occurred, and the toner consumption was evaluated. The operating conditions in the endurance test are the same as those described in the first embodiment except that conditions on voltages applied to the charging roller 2 and the developing roller 41 for the image-deletion suppressing operation differ. The same endurance test was conducted also for the first embodiment for comparison. The evaluation of the toner consumption was performed by measuring the weight of toner in the developing unit 4 after the endurance test. The results of the second embodiment and the first embodiment are shown in Table 2.

TABLE 2

| | Image deletion | Weight of toner in developing unit after completion of test |
|---|---|---|
| Second embodiment | Good | 16.9 |
| First embodiment | Good | 15.2 |

Good: No problem in output image
Poor: image with image deletion
Okay: no image deletion but streaks in output image No image deletion occurred in both of the second embodiment and the first embodiment. In the first embodiment, the weight of toner in the developing unit 4 after the endurance test was 15.2 g, whereas it was 16.9 g in the second embodiment. Thus, in the present embodiment, toner consumption can be lower than that in the first embodiment. This seems to be because spattering of toner from the developing roller 41 toward the photosensitive drum 1 can be suppressed by appropriately setting the potential difference Vback at the image-deletion suppressing operation.

In this way, in the present embodiment, the control unit 50 applies a voltage to the developing roller during the image-deletion suppressing operation (during the rotating operation). The control unit 50 charges the surface of the photosensitive drum 1 that the developing roller 41 is in contact using the charging roller 2 during the rotating operation.

As described above, the present embodiment offers the same advantageous effects as those of the first embodiment and reduces toner consumption due to the image-deletion suppressing operation.

Third Embodiment

Next, still another embodiment of the present disclosure will be described. The basic configuration and operation of an image forming apparatus according to the second embodiment are the same as those of the image forming apparatus according to the first embodiment. For that reason, components having the same or corresponding functions or configurations of the image forming apparatus of the present embodiment as those of the image forming apparatus of the first embodiment are given the same reference signs as those of the first embodiment, and detailed descriptions will be omitted.

1. Outline of the Present Embodiment

In the second embodiment, toner consumption is reduced by suppressing spattering of toner from the developing roller 41 toward the photosensitive drum 1 by appropriately setting the potential difference Vback during the image-deletion suppressing operation.

Figure 11:
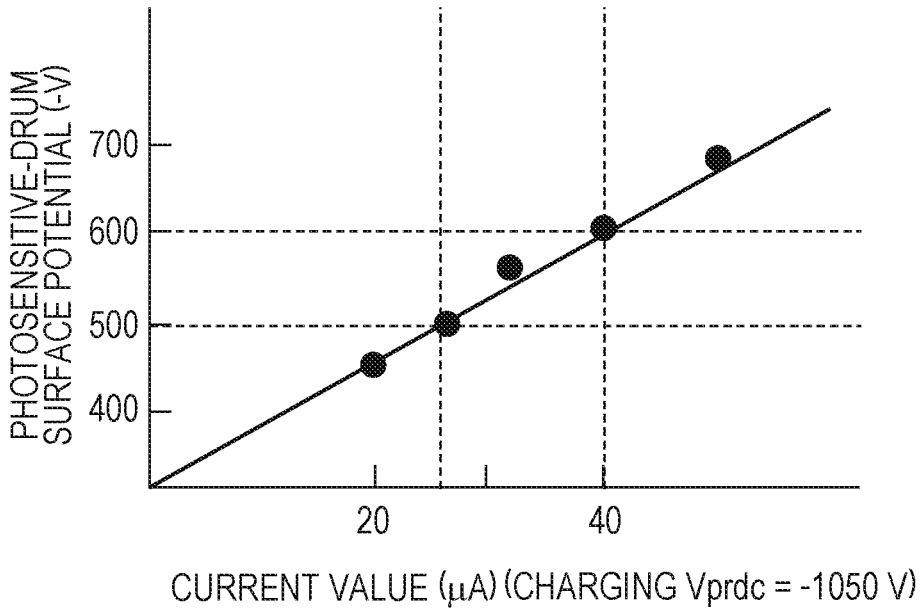
FIG. 11 is a graph showing the relationship between the detected current value and the charge potential of a photosensitive drum according to a third embodiment of the present disclosure.

FIG. 11 shows the relationship between electric current values detected by the current detection circuit 14, each of which indicates the amount of discharge products adhering to the surface of the photosensitive drum 1, and the charge potential of the photosensitive drum 1 at that time during the execution of the image-deletion suppressing operation of the second embodiment. As illustrated in FIG. 11, the charge potential of the photosensitive drum 1 changes according to the detected electric current value serving as an index indicating the amount of discharge products adhering to the surface of the photosensitive drum 1. In other words, the charge potential of the photosensitive drum 1 decreases as the amount of discharge products adhering to the surface of the photosensitive drum 1 decreases, and the detected electric current value decreases. For that reason, with the control procedure of the second embodiment, the potential difference Vback is appropriate at the beginning of the image-deletion suppressing operation but is decreased as image-deletion suppressing operation is continued and the amount of discharge products adhering to the surface of the photosensitive drum 1 decreases. Thus, with the control procedure of the second embodiment, fogging increases as the image-deletion suppressing operation is continued, and the amount of discharge products adhering to the surface of the photosensitive drum 1 decreases.

Because of this, the present embodiment appropriately sets the potential difference Vback according to the amount of discharge products adhering to the surface of the photosensitive drum 1 by changing the voltage to be applied to the developing roller 41 during execution of the image-deletion suppressing operation. In other words, the voltage to be applied to the developing roller 41 is changed according to the amount of adhering discharge products so that the potential difference Vback is maintained at or brought close to a predetermined value. In the present embodiment, the charging voltage Vprdc, which is a DC voltage to be applied to the charging roller 2 during the image-deletion suppressing operation, is set to −1,050 V. The initial value of the developing voltage Vdc, which is a DC voltage to be applied to the developing roller 41 during the image-deletion suppressing operation, is set to −450 V. The developing voltage Vdct is changed according to the electric current value detected by the current detection circuit 14. In the present embodiment, the developing voltage Vdc is changed so that the potential difference Vback approaches 150 V. This further reduces toner consumption during the image-deletion suppressing operation as compared with the second embodiment.

In the present embodiment, the developing voltage Vdc is changed in two levels, but may be changed in more levels. To appropriately set the potential difference Vback, the charging voltage Vprdc may be changed, or both of the charging voltage Vprdc and the developing voltage Vdc may be changed.

2. Control Procedure

Figure 12:
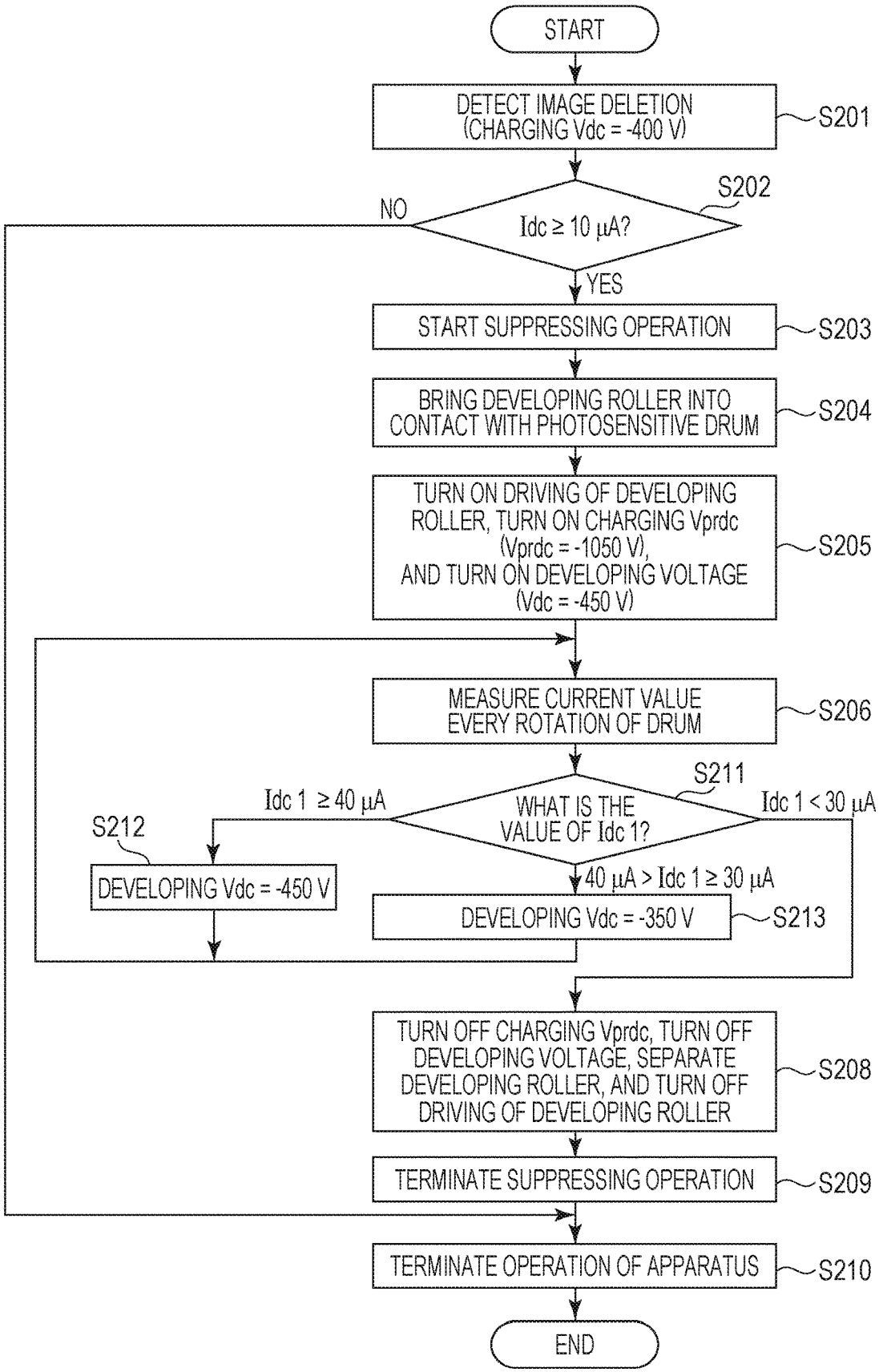
FIG. 12 is a flowchart illustrating, in outline, a control procedure according to the third embodiment.

Next, the control procedure of the image-deletion detecting operation and the image-deletion suppressing operation of the third embodiment will be described. FIG. 12 is a flowchart illustrating, in outline, the control procedure of the image-deletion detecting operation and the image-deletion suppressing operation of the present embodiment. In FIG. 12, substantially the same operations as the operations of the control procedure of the second embodiment illustrated in FIG. 10 are given the same step numbers (S201 to S206, S208 to S210), and detailed descriptions will be omitted.

In the present embodiment, the control unit 50 determines whether the electric current value Idc1 obtained in S206 is greater than or equal to 40 μA, greater than or equal to 30 μA and less than 40 μA, or less than 30 μA every time the electric current value Idc1 is obtained (S211). If in S211 the control unit 50 determines that the electric current value Idc1 is greater than or equal to 40 μA (Idc1≥40 μA), the control unit 50 determines to maintain the developing voltage Vdc at −450 V (S212) and returns the process to S206 to continue the discharge-product scraping operation using the developing roller 41. If in S211 the control unit 50 determines that the electric current value Idc1 is greater than or equal to 30 μA and less than 40 μA (40 μA>Idc1≥30 μA), the control unit 50 changes the developing voltage Vdc to −350 V (S213). The control unit 50 returns the process to S206 to continue the discharge-product scraping operation using the developing roller 41. If in S211 the control unit 50 determines that the electric current value Idc1 is less than 30 μA (Idc1<30 μA), the control unit 50 advances the process to S208 to terminate the image-deletion suppressing operation.

3. Advantageous Effects

Next, the results of an endurance test conducted to verify the advantageous effects of the third embodiment will be described. The endurance test was conducted in the same manner as described in the first embodiment, in which it was determined whether image deletion occurred, and the toner consumption was evaluated. The operating conditions in the endurance test are the same as those described in the first embodiment except that conditions on voltages applied to the charging roller 2 and the developing roller 41 for the image-deletion suppressing operation differ. The same endurance test was conducted also for the first embodiment for comparison. The evaluation of the toner consumption was performed by measuring the weight of toner in the developing unit 4 after the endurance test. The results of the third embodiment and the first embodiment are shown in Table 3.

TABLE 3

| | Image deletion | Weight of toner in developing unit after completion of test |
|---|---|---|
| Third embodiment | Good | 18.7 |
| First embodiment | Good | 15.2 |

Good: No problem in output image
Poor: image with image deletion
Okay: no image deletion but streaks in output image No image deletion occurred in both of the third embodiment and the first embodiment. In the first embodiment, the weight of toner in the developing unit 4 after the endurance test was 15.2 g, whereas it was 18.7 g in the third embodiment. Thus, in the present embodiment, toner consumption can be lower than that in the first embodiment. Furthermore, as illustrated in Table 2 of the second embodiment and in Table 3, toner consumption can be lower than that in the second embodiment. This seems to be because spattering of toner from the developing roller 41 toward the photosensitive drum 1 can be suppressed more than that in the second embodiment by appropriately setting the potential difference Vback at the image-deletion suppressing operation according to the amount of discharge products adhering to the surface of the photosensitive drum 1.

In this way, in the present embodiment, the control unit 50 changes the voltage to be applied to the developing roller 41 for the rotating operation based on the result of detection made by the detecting unit 14. The control unit 50 decreases the absolute value of the voltage to be applied to the developing roller 41 as the absolute value of the electric current value detected by the detecting unit 14 decreases. In other words, the control unit 50 sets the absolute value of the voltage to be applied to the developing roller 41 to be smaller when the absolute value of the electric current value detected by the detecting unit 14 is a second value smaller than a first value than when the absolute value is the first value.

As described above, the third embodiment offers the same advantageous effects as those of the first embodiment and further reduces toner consumption due to the image-deletion suppressing operation.

Other Embodiments

Although the present disclosure has been described with reference to specific embodiments, the present disclosure is not limited to the above embodiments.

In the above embodiments, to determine whether to terminate the image-deletion suppressing operation, an electric current flowing due to an injected charge when a voltage is applied to the developing roller 41 is detected. This allows detecting the electric current flowing due to the injected charge at relatively high frequency to determine whether discharge products have been removed while performing the discharge-product scraping operation using the developing roller 41, and when the discharge products have been removed, allows speedily terminating the scraping operation. However, the present disclosure is not limited to the above. The electric current flowing due to the injected charge when a voltage is applied to the charging roller 2 may be detected as in the case of determining whether to start the image-deletion suppressing operation. In this case, for example, after the image-deletion suppressing operation is started, the image-deletion suppressing operation is temporarily interrupted, and the electric current value due to the injected charge is detected. According to the detection result, it may be determined whether to resume or terminate the image-deletion suppressing operation. The contact member that applies a voltage to the photosensitive drum 1 to detect an electric current flowing due to the injected charge is not limited to the charging roller 2 or the developing roller 41 but may be the transfer roller 5, for example. The contact member may be any contact member that is in direct-contact with the photosensitive drum 1 or in contact therewith via an intermediate transfer member or a recording-material carrying member and that has sufficient conductivity to apply a voltage to the photosensitive drum 1. In other words, the contact member may be at least one of the charging member in contact with the image bearing member, the developing member, and the transfer member in contact with the image bearing member.

In the above embodiments, the current detection circuit 14 is connected between the photosensitive drum 1 and the ground. Alternatively, the current detection circuit 14 may be directly connected to a power source that applies a voltage to a contact member, such as the charging roller 2, the developing roller 41, or the transfer roller 5. In the above embodiments, the electric current flowing when a predetermined voltage is applied to the contact member from a power source is detected using the current detection circuit 14. Alternatively, a voltage when a predetermined electric current is made flow across a contact member using a power source may be detected. For example, the control unit 50 may change the set value of the output from the power source so that the electric current value detected by the current detection circuit 14 reaches a predetermined value, and the voltage value may be detected from the set value of the output from the power source when the predetermined electric current value is obtained. In that case, for example, the control unit 50 serves as the detecting unit 14 for detecting the voltage value. In other words, the detecting unit 14 may detect a change in electric current or a change in voltage when a voltage is applied to the contact member from the power source.

In the above embodiments, the image forming apparatus 100 employs a cleanerless system. Although the present disclosure is particularly suitably applicable to the cleanerless image forming apparatus 100, the present disclosure is not limited thereto. The present disclosure is also applicable to an image forming apparatus 100 including a dedicated cleaning unit for removing toner remaining on the surface of the photosensitive drum 1 after the transfer process.

In the above embodiments, only a DC voltage is applied as a charging voltage to the charging roller 2 at the time of image formation. Alternatively, an oscillating voltage in which a DC voltage and an alternating current voltage are superposed may be applied as a charging voltage to the charging roller 2 for image formation. In the above embodiments, only a DC voltage is applied as a developing voltage to the developing roller 41 at the time of image formation. Alternatively, an oscillating voltage in which a DC voltage and an alternating current voltage are superposed may be applied to the developing roller 41 at the time of image formation.

In the above embodiments, the image forming apparatus 100 is a monochrome image forming apparatus including a single image forming unit. Alternatively, the present disclosure may also be applied to a tandem color image forming apparatus that employs an intermediate transfer system or a direct transfer system including a plurality of image forming units. As is well known to those skilled in the art, in the intermediate transfer type image forming apparatus, a toner image formed on the photosensitive drum 1 of each image forming unit is primarily transferred to an intermediate transfer member (an intermediate transfer belt) formed of an endless belt or the like and is then secondarily transferred to a recording material, as in the above embodiments. In the direct transfer type image forming apparatus, the toner image formed on the photosensitive drum 1 of each image forming unit is directly transferred to a recording material carried and conveyed by a recording-material carrying member (a recording-material carrying belt) formed of an endless belt, as in the above embodiments. The present disclosure can also be applied to such image forming apparatuses to reduce the influence of discharge products adhering to the photosensitive drum 1 of each image forming unit.

In the above embodiments, the image-deletion detecting operation and the image-deletion suppressing operation are executed in the post-rotation process as the non-image-forming period. The present disclosure is not limited thereto. The image-deletion detecting operation and the image-deletion suppressing operation may be executed at any timing in the non-image-forming period.

The charging member, such as the charging roller 2, may not necessarily be in contact with the surface of a member to be charged, such as the photosensitive drum 1. The charging member may be disposed near the member to be charged, with a gap of tens of micrometers therebetween that ensures a chargeable region based on the Paschen's law between the charging member and the charged member. The charging member is not limited to the roller-shaped member but may be a belt-like member, a pad-like member, a blush-like member, or the like. The developing member is not limited to the roller-shaped member but may be any rotatable member, such as an endless belt. The transfer member is not limited to the roller-shaped member but may be a pad-like member or a blush-like member. The photosensitive member is not limited to the drum-shaped member (the photosensitive drum) but may be an endless-belt like member (a photosensitive belt). The intermediate transfer member and the recording-material carrying member are not limited to the endless-belt like members but may be drum-shaped members formed by stretching a film around a frame.

The discharge starting voltage Vth can change according to, for example, the thickness of the photosensitive layer of the photosensitive member, as described above. Accordingly, the value of the DC voltage can be set to be sufficiently less than the discharge starting voltage Vth in advance according to the use environment or the life of the image forming apparatus 100. Alternatively, the characteristics of the discharge starting voltage Vth that changes according to various factors may be obtained in advance by experiment, the present discharge starting voltage Vth may be estimated as appropriate, and the value of the DC voltage less than the discharge starting voltage Vth may be changed according to the estimation. In the image forming apparatus 100, a plurality of test voltages may be applied to the contact member such as the charging member to obtain current-voltage characteristics, and the discharge starting voltage Vth may be obtained from the characteristics. Typically, at least one DC voltage lower than the discharge starting voltage Vth and at least one DC voltage higher than the discharge starting voltage Vth are applied, and electric currents that flow across the charging power source when the voltages are applied are measured. Thus, the electric current-voltage characteristics illustrated in FIG. 5 can be obtained. The discharge starting voltage Vth can be obtained from the inflection point of the obtained characteristics, for example. The inflection point corresponds to a voltage value in the case where the electric current value is 0 μA in the current-voltage characteristics in a voltage range higher than the discharge starting voltage Vth. The operation for obtaining the discharge starting voltage Vth can be performed at a predetermined timing in the non-image-forming period. The predetermined timing is determined according to the environment and can be set to a timing when at least one of the temperature and the humidity has changed over a predetermined range, or a timing when an index value correlated with the amount of the photosensitive member used exceeds a predetermined threshold, and the like. Examples of the index value correlated with the amount of the photosensitive member used include the number of rotations, rotation time, the time during which the charging process is performed, the number of sheets on which images are formed, and any other values.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-173444 filed Sep. 8, 2017, which is hereby incorporated by reference herein in its entirety.

What is claimed is:

1. An image forming apparatus comprising:

a rotatable image bearing member;

a charging member configured to charge a surface of the image bearing member;

a developing member, rotating while being in contact with the image bearing member, configured to supply a developer to the surface of the image bearing member charged by the charging member;

a transfer member configured to transfer an image formed of the developer on the image bearing member to a transferred member;

a contact member configured to contact the image bearing member;

a developing voltage power source configured to apply a developing voltage to the developing member;

a contact and separation mechanism configured to switch the developing member and the image bearing member between a contact state in which the developing member is in contact with the image bearing member at a contact portion where the image bearing member and the developing member are in contact and a separated state in which the developing member is separated from the image bearing member;

a detecting circuit configured to detect a value of an electric current flowing from the contact member to the image bearing member or a voltage generated between the contact member and the image bearing member when a direct-current voltage less than a discharge starting voltage is applied to the contact member in contact with the image bearing member; and a controller configured to execute detection using the detecting circuit in a non-image-forming period to obtain a detection result, wherein when a detection result obtained by the detecting circuit satisfies a first condition in the separated state in which the developing member is separated from the image bearing member, the controller starts a rotating operation for rotating the image bearing member and the developing member in the contact state in which the developing member is in contact with the image bearing member and an absolute value of the developing voltage that is applied to the developing member is less than an absolute value of a discharge starting voltage between the developing member and the image bearing member during the rotating operation, and wherein when the detection result satisfies a second condition in the contact state in which the developing member is in contact with the image bearing member during the rotating operation, the controller terminates the rotating operation in the separated state in which the developing member is separated from the image bearing member.

2. The image forming apparatus according to claim 1, wherein, when the first condition that an absolute value of the electric current or the voltage detected by the detecting circuit is greater than or equal to a first threshold is satisfied, the controller starts the rotating operation, and wherein, when the second condition that the absolute value of the electric current or the voltage detected by the detecting circuit becomes less than a second threshold is satisfied, the controller terminates the rotating operation.

3. The image forming apparatus according to claim 2, wherein the controller determines whether the detection result satisfies the second condition every time the image bearing member rotates once.

4. The image forming apparatus according to claim 1, wherein the controller controls a voltage to be applied to the developing member during the rotating operation.

5. The image forming apparatus according to claim 4, wherein the controller controls a charge of the surface of the image bearing member that the developing member is in contact applied by the charging member during the rotating operation.

6. The image forming apparatus according to claim 4, wherein the controller controls a change of the voltage to be applied to the developing member during the rotating operation based on the detection result.

7. The image forming apparatus according to claim 6, wherein the controller controls a decrease of an absolute value of the voltage to be applied to the developing member as an absolute value of the electric current or the voltage detected by the detecting circuit decreases.

8. The image forming apparatus according to claim 1, wherein the developing member collects a developer remaining on the surface of the image bearing member after the image formed of the developer is transferred from the image bearing member to the transferred member.

9. An image forming apparatus comprising:

a rotatable image bearing member;

a charging member configured to charge a surface of the image bearing member;

a developing member, rotating while being in contact with the image bearing member, configured to supply a developer to the surface of the image bearing member charged by the charging member;

a transfer member configured to transfer an image formed of the developer on the image bearing member to a transferred member;

a developing voltage power source configured to apply a developing voltage to the developing member;

a contact and separation mechanism configured to switch the developing member and the image bearing member between a contact state in which the developing member is in contact with the image bearing member at a contact portion where the image bearing member and the developing member are in contact and a separated state in which the developing member is separated from the image bearing member;

a detecting circuit configured to detect a value of an electric current flowing from at least one of the charging member, the developing member, and the transfer member to the image bearing member or a voltage generated between the at least one of the charging member, the developing member, and the transfer member and the image bearing member when a direct-current voltage less than a discharge starting voltage is applied to at least one of the charging member, the developing member, or the transfer member in contact with the image bearing member; and a controller configured to execute detection using the detecting circuit in a non-image-forming period to obtain a detection result, wherein when the obtained detection result obtained by the detecting circuit satisfies a first condition in the separated state in which the developing member is separated from the image bearing member, the controller starts a rotating operation for rotating the image bearing member and the developing member in the contact state in which the developing member is in contact with the image bearing member and an absolute value of the developing voltage that is applied to the developing member is less than an absolute value of a discharge starting voltage between the developing member and the image bearing member during the rotating operation, and wherein when the obtained detection result satisfies a second condition in the contact state in which the developing member is in contact with the image bearing member during the rotating operation, the controller terminates the rotating operation in the separated state in which the developing member is separated from the image bearing member.

10. The image forming apparatus according to claim 9, wherein, when the first condition that an absolute value of the electric current or the voltage detected by the detecting circuit is greater than or equal to a first threshold is satisfied, the controller starts the rotating operation, and wherein, when the second condition that the absolute value of the electric current or the voltage detected by the detecting circuit becomes less than a second threshold is satisfied, the controller terminates the rotating operation.

11. The image forming apparatus according to claim 9, wherein the controller determines whether the detection result obtained using the charging member satisfies the first condition and determines whether the detection result obtained using the developing member satisfies the second condition.

12. The image forming apparatus according to claim 11, wherein the controller determines whether the detection result satisfies the second condition every time the image bearing member rotates once.

13. The image forming apparatus according to claim 9, wherein the controller controls a voltage to be applied to the developing member during the rotating operation.

14. The image forming apparatus according to claim 13, wherein the controller controls a charge of the surface of the image bearing member that the developing member is in contact applied by the charging member during the rotating operation.

15. The image forming apparatus according to claim 14, wherein the controller controls a change of the voltage to be applied to the developing member during the rotating operation based on the detection result.

16. The image forming apparatus according to claim 15, wherein the controller controls a decrease of an absolute value of the voltage to be applied to the developing member as an absolute value of the electric current or the voltage detected by the detecting circuit decreases.

17. The image forming apparatus according to claim 9, wherein the developing member collects a developer remaining on the surface of the image bearing member after the image formed of the developer is transferred from the image bearing member to the transferred member.

* * * * *